United States Patent [19]

Richards

[11] Patent Number: 4,880,221

[45] Date of Patent: Nov. 14, 1989

[54] TABLE FOR HOLDING WORK PIECES FOR DRILLING, CUTTING AND THE LIKE

[76] Inventor: David M. Richards, 205 Washington, Ida Grove, Iowa 51445

[21] Appl. No.: 42,047

[22] Filed: Apr. 24, 1987

[51] Int. Cl.[4] ..... B25B 1/02

[52] U.S. Cl. ..... 269/139; 269/99; 269/262; 269/282; 269/901

[58] Field of Search ..... 269/139, 99, 258, 262, 269/272, 282, 901

[56] References Cited

U.S. PATENT DOCUMENTS

| | | | |
|---|---|---|---|
| 91,625 | 6/1869 | Henderson | 269/139 |
| 3,342,226 | 9/1967 | Marcoux et al. | 269/901 |
| 4,127,260 | 11/1978 | Hickman | 269/901 |
| 4,328,846 | 5/1982 | Hanson | 269/901 |
| 4,422,629 | 12/1983 | Carlson | 269/282 |

FOREIGN PATENT DOCUMENTS

| | | | |
|---|---|---|---|
| 2190618 | 3/1987 | United Kingdom | 269/139 |

*Primary Examiner*—Judy Hartman
*Attorney, Agent, or Firm*—John A. Beehner

[57] ABSTRACT

A work piece holding device which includes a rectangular table top supported above the ground at a convenient work height and which has a fixed jaw at one end a facing sliding jaw which may be affixed to the table top at any point along the table either parallel to or at variable angles with the fixed jaw. Two inverted T-shaped slots in the table top provide guides for inverted bolts having parallel bolt head sides which firmly set the sliding jaw at the desired position and angular orientation. A variety of pairs of auxiliary jaw shapes for special jobs and a plurality of short screws placed along one of the jaws for applying resisting torque to one member of a particular pair of the auxiliary jaw shapes at one or more specific locations along that jaw are provided as well as an extender which provides for holding a work piece having a comparatively long dimension.

7 Claims, 30 Drawing Sheets

TABLE FOR HOLDING WORK PIECES FOR DRILLING, CUTTING AND THE LIKE

TECHNICAL FIELD

This invention relates generally to devices for holding a work piece in the form of a pipe, rod, plates, or the like, in place for cutting, drilling, shaping or the like. More specifically it relates to a work piece holding table which can stabilize the position of such a piece when it is subject to a great deal of force in any particular direction or torque such as in a drilling operation

BACKGROUND ART

The closest known art is typified by the common workbench vise. Such a vise to has a fixed jaw and a movable jaw, the movable jaw opening and closing by the application of mechanical leverage through a screw which extends from the fixed jaw. The movable jaw is supported by one or more guides. Many variations of this device, some more complex and some highly specialized, are known.

Vises which employ guides and long parallel screws are capable of resisting strong forces and/or torque to hold a workpiece in a firm position. However, the wider the work piece is, the longer the screw must be to encompass its width. Long screws are not only expensive, but are subject to distortion and bending in use.

Another problem with such vises and variations of them is that they are not readily adaptable to holding work pieces not having parallel sides. Also, if a narrow work piece can not be centered over or near the screw of such a vise, the holding pressure required to avoid twisting of the piece out of the grip of the jaws is likely to damage the piece.

DISCLOSURE OF THE INVENTION

It is a general object of the present invention to provide an improved work piece holding table.

Another object is the provision of a work piece holding table which is capable of supporting either long or wide work pieces in a firm position.

An additional object of the present invention is to provide a work piece holding device which is readily adaptable to supporting work pieces not having parallel sides.

Yet another object of the invention is the provision of a work piece holding table which can apply torque near the point of contact with the jaws anywhere along the jaws.

More generally it is an object of the present invention to provide a work piece holding device which includes a rectangular table top supported above the ground at a convenient work height and which has a fixed jaw at one end and a facing sliding jaw which may be affixed to the table top at any point along the table either parallel to or at variable angles with the fixed jaw. Two inverted T-shaped slots in the table top provide guides for an inverted bolt having parallel bolt head sides to be used in firmly setting the sliding jaw at the desired position and angular orientation.

Other features include a variety of pairs of auxiliary jaw shapes for special jobs and a plurality of short screws placed along one of the jaws for applying resisting torque to one member of a particular pair of the auxiliary jaw shapes at one or more specific locations along that jaw.

Another feature of the present invention is an extender which provides for holding a work piece having a comparatively long dimension, such as a steel plate or 4×8 sheet of material.

These and other objects, advantages and novel features of the present invention will become apparent from the following detailed description of the invention when considered in conjunction with the accompanying drawings.

BEST MODE FOR CARRYING OUT THE INVENTION

Figure 1:
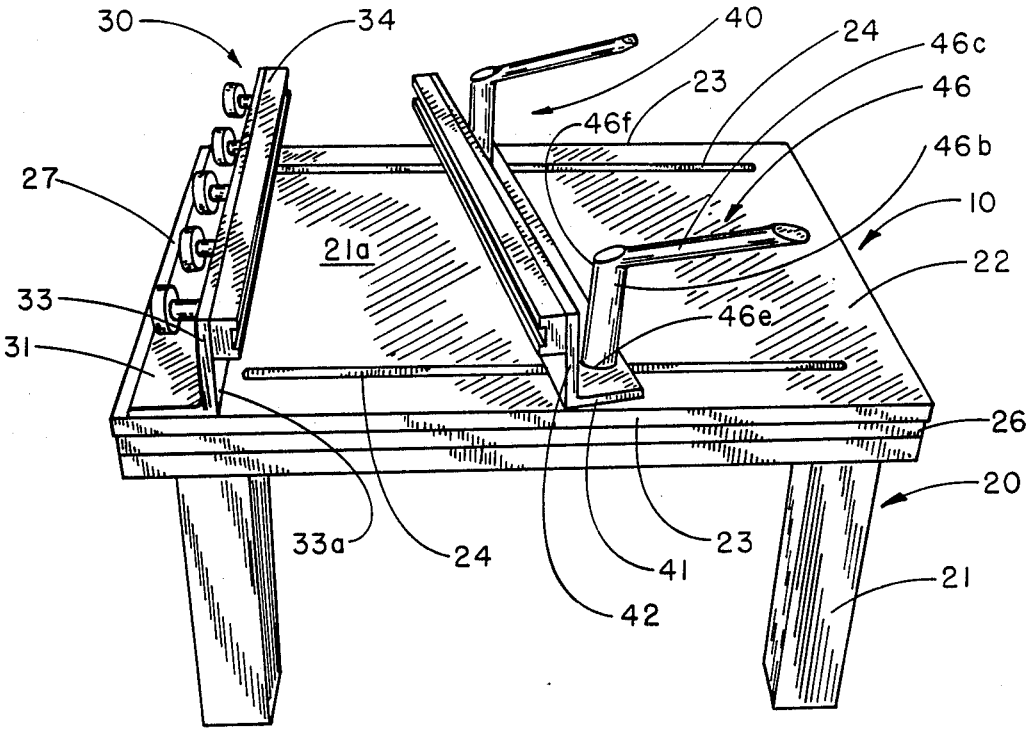
FIG. 1 is a perspective view of the work piece holding table of the present invention showing the sliding jaw positioned at an angle to the torque jaw.

Referring now to the drawing, in which identical or corresponding parts are indicated by the same reference character throughout the several views, and more particularly to FIG. 1 whereon the present invention is designated generally at 10, work piece holding table 10 is comprised of a table assembly designated generally at 20, a torque jaw support designated generally at 30, and a sliding jaw support designated generally at 40. Work piece holding table 10 is further comprised of a variety of pairs of auxiliary jaw pieces, designated generally at 50 (see FIGS. 8 through 14), and of sliding table and jaw combination, designated generally at 60 (see FIG. 10). It should be understood that legs 21 of table top assembly 20 are representative only of a wide variety of means for supporting table top 22 at a convenient work level above the ground. More typically table top 22 would be resting on a heavy steel or iron base.

Running parallel to two of the sides 23 of rectangular table top 22 are two equal slots 24, one a short distance from one of said sides 23 and the other a comparable distance from the other side. As can be best seen in FIGS. 2 through 10, slots 24 are T-shape in cross-section, the "T" being inverted. Also shown in FIGS. 1 through 10 are two stiffeners 26 which are parallel with slots 24 and are each located between one slot 24 and one side 23. Stiffeners 26 also serve as guides for table extension 61 of sliding table and jaw combination 60 which will be described hereinafter.

Torque jaw support 30 is comprised of an angle iron having a horizontal flange 31 bolted at 32 to upper side 21*a* near a side 27 which is perpendicular to sides 23 of table top 21. Vertical flange 33 of torque jaw support 30 is distal side 27 with respect to horizontal flange 31. U-shaped jaw piece 34 is affixed in a well-known manner to side 33*a* above table top 21 of flange 33, side 33*a* being that side of flange 33 which faces away from side 27 of table top 21. Jaw piece 34 is oriented such that the "U" of its shape opens towards the opposite side 28 of table top 21.

Figure 2:
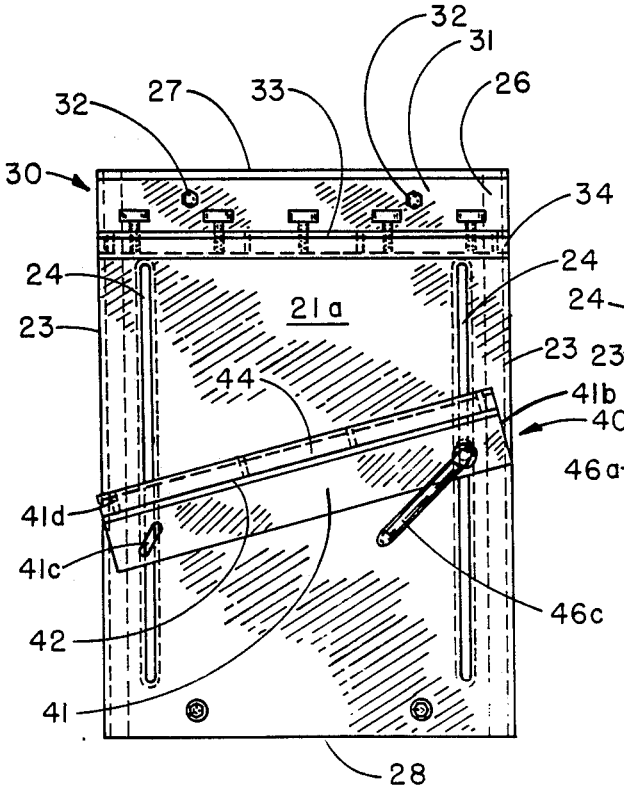
FIG. 2 is a reduced top plan view of the table top thereof, the bolt and nut with handle combination over the elongated angled hole in the sliding jaw not shown.
Figure 3:
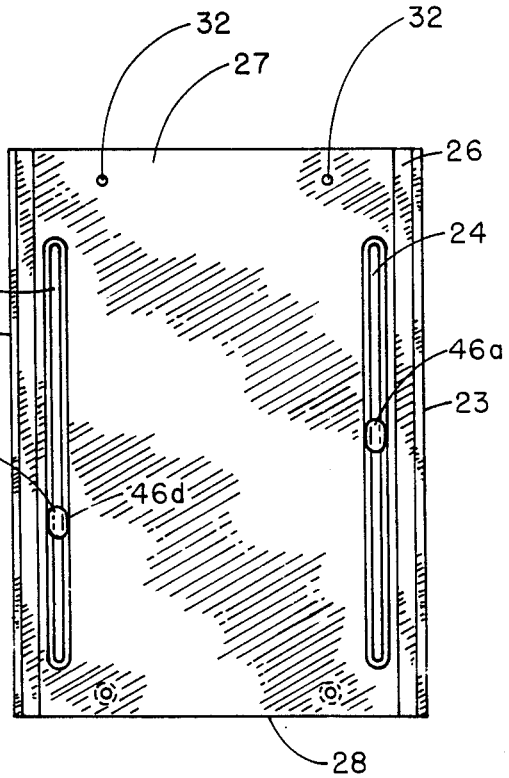
FIG. 3 is a reduced bottom plan view of the table top thereof.

Referring now to FIGS. 2 and 3, sliding jaw support 40 is comprised of a horizontal flange 41 and a vertical flange 42, said vertical flange 42 being located proximal vertical flange 33 of torque jaw support 30 with respect to horizontal flange 41 when sliding jaw support 40 is in position for use. Horizontal flange 41 has a circular hole 41*a* (see FIGS. 5 and 7) near one end 41*b* of flange 41 and which will be centered over one slot 24 of table top 21 when sliding jaw support 40 is operably affixed thereto Flange 41 has a second hole 41*c* (see also FIGS. 8 and 9) which is elongated, canted, and near its other end 41*d*. A portion of second hole 41*c*, sufficient to permit sliding jaw support 40 to be angularly oriented with respect to torque jaw support 30, from an acute angle to parallel, will be over the other slot 24 when sliding jaw support 40 is operably affixed thereto.

Affixed in a well known manner to that side of vertical flange 42 which will face torque jaw support 30 when sliding jaw support 40 is operably affixed to table top 21 is U-shaped jaw piece 44. U-shaped jaw piece 44 is the equal and opposite mate of U-shaped jaw 34, and the "U" of its shape opens towards side 27 of table top 21.

Referring again to FIG. 1, two "nut-handle and bolt combinations," designated generally at 46, are employed to operably affix sliding jaw support 40 to table top 21. The two combinations 46 are identical and are each comprised of bolt 46*a* (see FIGS. 3, 4, 5, and 7), sleeve 46*b*, and arm 46*c*.

Bolt 46*a* has a shank slightly smaller in diameter than the narrow, upper width of slot 24 (also hole 41*a* whose diameter is equal to that width of slot 24). The head of bolt 46*a* has at least two straight parallel sides 46*d* (see FIG. 3) which are spaced a distance slightly less than the wide, lower width of slot 24 and greater than that of the upper, narrow width thereof. Thus, when bolt 46*a* is inserted through slot 24 from the lower side 21*b* of table top 21 so that its head slips into the wide, lower portion of slot 24, bolt 46*a* may be slid along slot 24, but it cannot turn.

Sleeve 46*b* is threaded at a first end 46*e* to cooperate with bolt 46*a* and may be thought of as a nut and having a hollow extension affixed on one side, the extension serving to permit one's hand to grip an arm affixed somewhat normal thereto without being restricted by table top 21. Arm 46*c* is affixed to second end 46*f* of sleeve 46*b* at a slightly upward angle with respect to table top 21. This angle is that which is calculated to permit a man of average height to conveniently grasp arm 46*c* and give a turn through that part of an arc required to affix sliding torque jaw 40 to table top 21 at a desired location.

Each member of each pair of auxiliary jaw pieces 50 includes a base portion 51 and a jaw portion 52. The base portion 51 of a member of any pair of auxiliary jaw piece 50 is the same as that of any other member of the various pairs. It is comprised of an elongated base 51 of substantially rectangular cross-section, the rectangular section thereof being of such dimensions so as to fit snugly within the "U" shape of either jaw piece 34 or jaw piece 44. Extending normally from the side of base 51 which will be in contact with the normally horizontal portion of said "U" shape are a plurality of spaced apart threaded protrusions 51*a*. Protrusions 51*a* are located so as to extend through a plurality of identically spaced apart holes 34*a* (see FIG. 6) and 44*a* (see FIG. 7) running through jaw pieces 34 and 44 as well as flange 33 and 42 of torque jaw support 30 and sliding jaw support 40, respectively. Plurality of nuts 51*c* are threaded to cooperate with protrusions 51*a*, such that when any particular pair of auxiliary jaw pieces 50 is desired, one member may be mounted on jaw piece 34 and the other member mounted on jaw piece 44 by first inserting said protrusions 51*b* through holes 34*a* and 44*b*, respectively, until each base portion 51 is solidly set within the "U" shape of jaw pieces 34 and 44, respectively, and then threading nuts 51*c* onto protrusions 51*a*.

Figure 4:
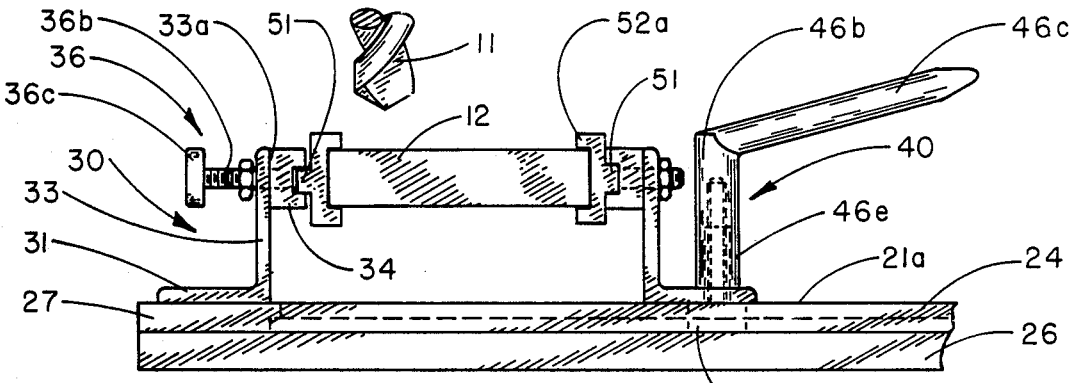
FIG. 4 is a partial enlarged side view of the table top thereof showing a work piece having a rectangular cross-section being held in position to have a hole drilled in it.
Figure 5:
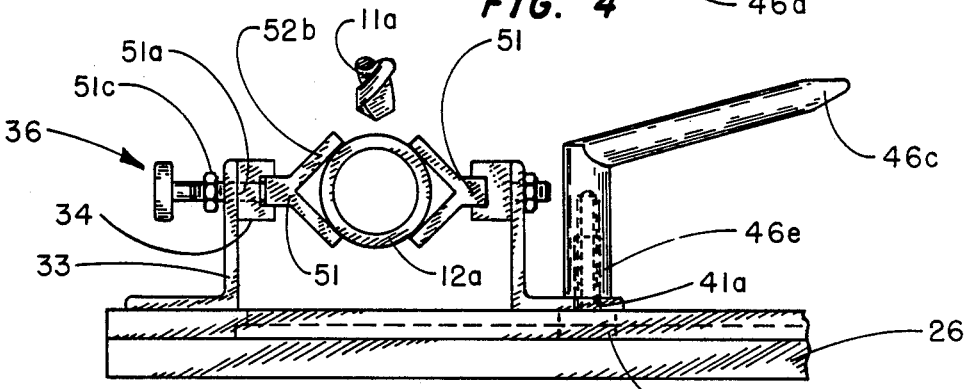
FIG. 5 is a partial enlarged side view of the table top thereof showing a circular pipe being held in position to have a hole drilled in it.
Figure 6:
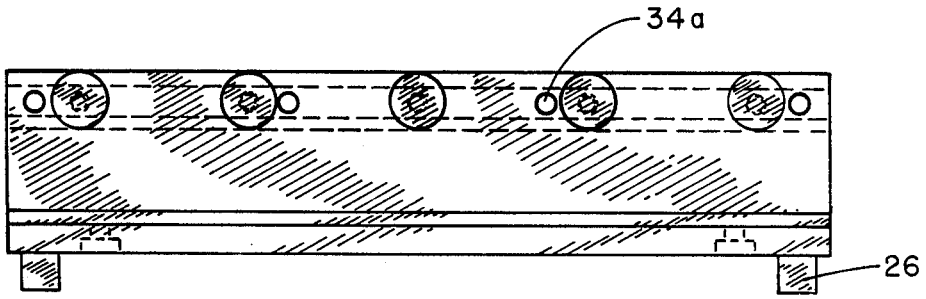
FIG. 6 is an enlarged end view of the torque jaw end of the table top thereof.
Figure 7:
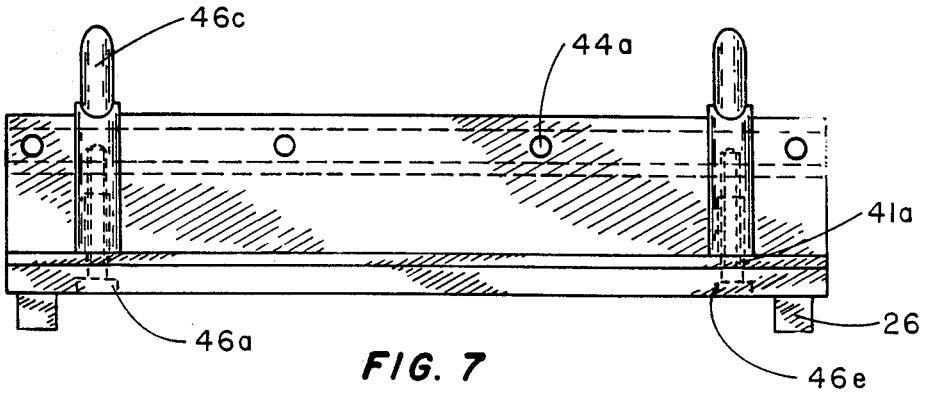
FIG. 7 is an enlarged end view of the sliding jaw end of the table top thereof.
Figure 8:
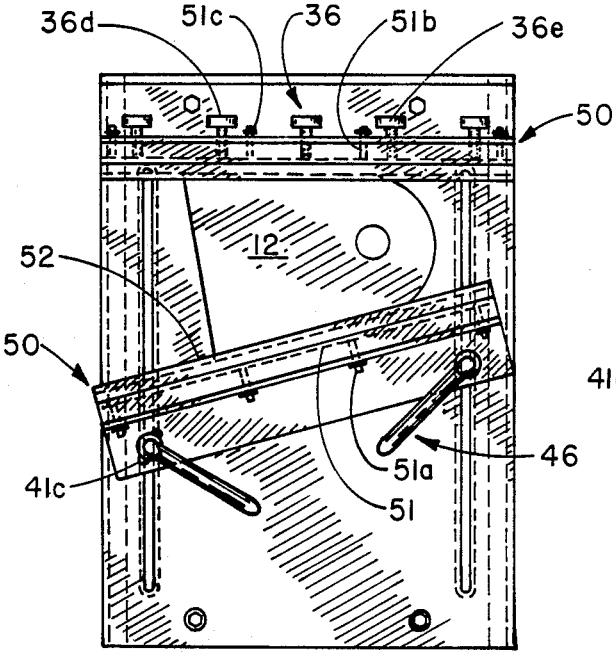
FIG. 8 a reduced top plan view of the table top thereof holding a four-sided work piece having one side curved and no sides parallel.
Figure 9:
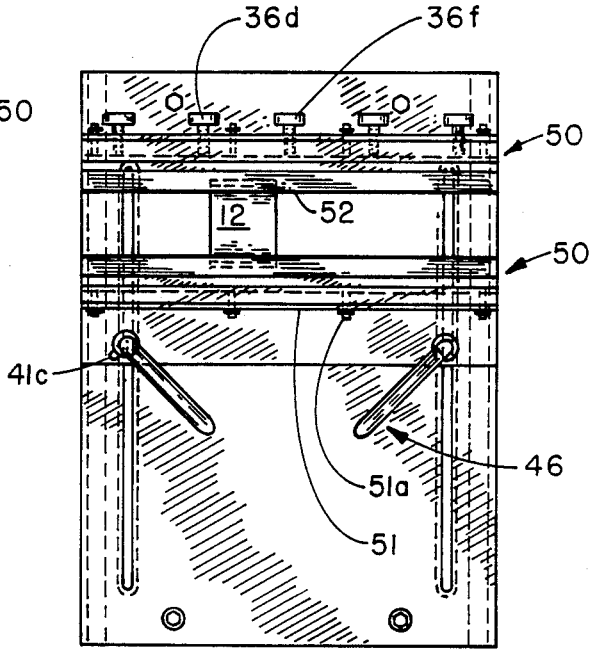
FIG. 9 is a reduced top plan view of the table top thereof holding a work piece having parallel sides.
Figure 10:
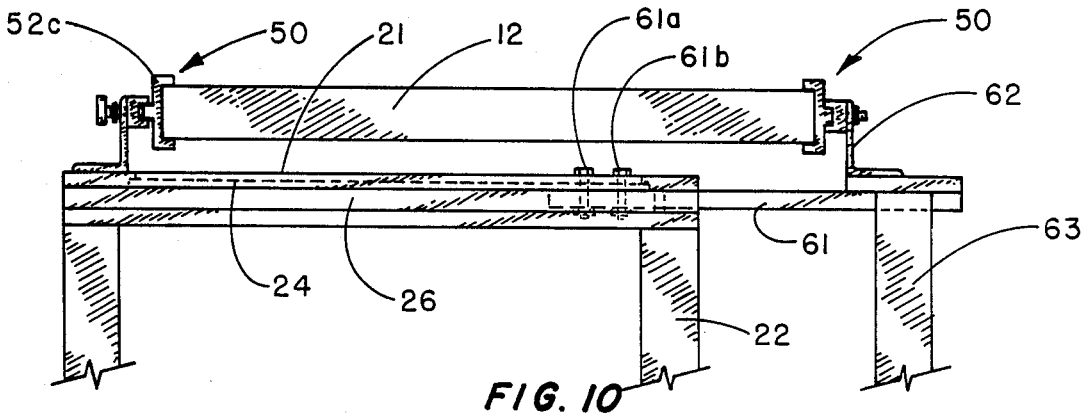
FIG. 10 is a side view thereof showing a table top extender in use to hold a comparatively long work piece.
Figure 11:
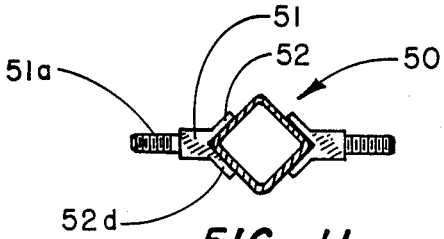
FIG. 11 is an enlarged side view of a pair of auxiliary jaws adapted to hold a pipe of square cross-section for performing operations at 45 degrees to its faces.
Figure 12:
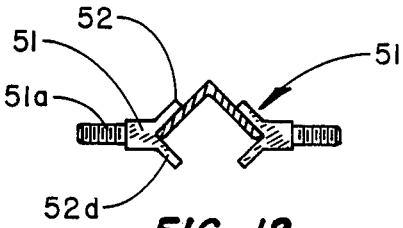
FIG. 12 is an enlarged side view of a pair of auxiliary jaws adapted to hold an angle for performing operations at 45 degrees to its, faces.
Figure 13:
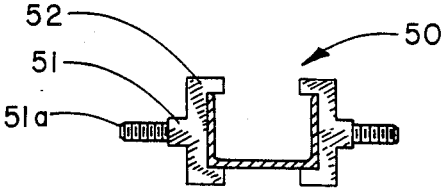
FIG. 13 is an enlarged side view of a pair of auxiliary jaws adapted to hold a channel.
Figure 14:
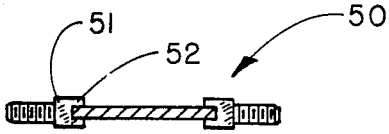
FIG. 14 is an enlarged side view of a pair of auxiliary jaws adapted to hold a plate.

Jaw portions 52 of each member of each pair of auxiliary jaw pieces 50 may be of an unlimited variety of shapes and sizes depending on the nature and size of the work piece and upon where and what type of work is to be accomplished. Some theoretical examples are shown in the Figures. In FIG. 4 drill bit 11 is about to drill a hole in a comparatively thick slab-like work piece 12. Jaw portions 52*a* are shaped and sized to dimensionally accomodate the ends of work piece 12, as are the thickness of its horizontal and vertical elements with respect to its mass. In like manner, in FIG. 5, where drill bit 11*a* is shown about to drill into work piece 12*a*, jaw portions 52*b* are shown as having comparatively long and thick upper and lower arms at 90 degrees to each other and 45 degrees to the table top. In contrast to jaw portions 52*a* and 52*b* of FIGS. 4 and 5, respectively, jaw portions 52*c* and 52*d* of FIGS. 10 and 11 show relatively less bulky elements where, perhaps a cutting operation is contemplated. FIG. 12 shows that the same jaw portion 52*d* might be suitable for either a square pipe, an angle (or a circular) pipe or rod for that matter. FIGS. 13 and 14 show some other variations of jaw portion 52, the variety being unlimited.

Referring again to FIG. 1, torque jaw support 30 has a plurality of torque knobs, designated generally at 36, each threadibly affixed within a plurality of threaded holes 36*a* which run through vertical flange 33 and U-shaped jaw piece 34. Threaded holes 36*a* are located mediate holes 34*a*, are axially parallel with sides 23 of table top 21 and are vertically positioned at the center of the normally horizontal portion of the "U" shape of jaw piece 34.

Torque knobs 36 are comprised of threaded shank portion 36*b* and a hand-turning portion 36*c*. Hand-turning portion 36*c* is disk-shaped and coaxial with shank-portion 36*b*. The edges of hand-turning portions 36*c* may be gnurled to resist slipping in the hand. Hand-turning portion 36c may also be rod shaped and thereby form the normally horizontal element of a "T" shape with shank portion 36b serving as the vertical element.

In operation, if it is elected not to simply hold the work piece 12 directly between jaw pieces 34 and 44, but rather to use a particular pair of auxiliary jaw pieces 50, said particular auxiliary jaw piece 50 is first either selected from existing stock or fashioned to meet the peculiar needs of the job. Next, one member of said particular jaw piece 50 is mounted onto jaw piece 34 of torque jaw support 30 and the other onto jaw piece 44 of sliding jaw piece 40 in the manner described hereinabove. Then work piece 12 is positioned within auxiliary jaw piece 50 as is represented best in FIG. 4. As can be appreciated from FIGS. 8 and 9, it does not matter whether the two sides of work piece 12 which are selected for placement within auxiliary jaw piece 50 are parallel or not. While the two nut-handle and bolt combinations 46 are loosened, sliding jaw support 40 is moved towards torque jaw support 30 until it firmly supports work piece 12 above table top 21. It may stop in a position such as that shown in FIG. 9 where it may be parallel or at a slight angle.

Next handle combinations 46 are tightened until sliding jaw support 40 is firmly set in this position. As will be appreciated shortly it is not necessary that sliding jaw support 40 be tightly affixed against work piece 12 or that work piece 12 be tight against fixed jaw support 30 to assure a firm position for work piece 12. Finally two or more of the plurality of torque knobs 36 are turned clockwise, serving to force the adjacent member of auxiliary jaw piece 50 towards the member thereof mounted in jaw piece 44 until work piece 12 is absolutely firmly in position within the auxiliary jaw piece 50 selected. It is usually advisable to loosen nuts 51c threaded onto the member of auxiliary jaw piece 50 which is mounted in jaw piece 34 in order to allow said member to move with work piece 12 towards sliding jaw support 40 until the position of work piece 12 is firmly set. This relationship between torque knobs 36 and threaded nuts 51c can best be seen in FIG. 5 where pipe 12a is supported by jaw portions 52b. Torque knob 36 has moved base portion 51a away from jaw piece 34 and nut 51c has been turned counter-clockwise away from flange 33. It is no longer necessary that nut 51c be employed to hold the member of auxiliary jaw piece 50 in place onto jaw piece 34.

It should be understood that, by having a plurality of torque knobs across the length of flange 33 of torque jaw support 30, just those knobs best located to firmly set the position of work piece 12 need be tightened. For instance, in FIG. 8 one might select knobs 36d and 36e as being the two which would most directly apply resisting torque to work piece 12. However, knobs 36d and 36f might be selected for the situation portrayed in FIG. 9.

When a work piece longer than the maximum distance between jaw supports 30 and 40 is confronted, sliding table and jaw support 60 may be used. As may be seen in FIG. 10, sliding table and jaw combination 60 is comprised of rectangular table extension 61, jaw support 62, and legs 63. Table extension 61 is of a width such that its sides will remain orthogonal with table top 21 by virtue of its contact on either side with stiffeners 26. When table and jaw combination 60 is to be used, the two sleeves 46b are removed from bolts 46a and the two nut-handle and bolt combinations 46, along with sliding jaw support 40 are removed from table top 21. Sliding table and jaw combination 60 is then placed in approximate position as desired and two conventional bolt and nut combinations 61a are placed, one through each slot 24 in table top 21 and a hole appropriately located in table extension 61 with respect to slots 24 and stiffeners 26. A second pair of bolt and nut combinations 61b may be employed for the purpose of further assuring proper alignment between table top 21 and table extension 61. Work piece 12 may then be positioned within a selected pair of auxiliary jaw pieces 50 and its position firmly established through the procedure described hereinabove with regard to torque knobs 36. Torque knobs 36 are ideally suited for accomodating work piece 12, if it is slightly out of square, as such long pieces of material often are.

It will be readily understood that the particular disposition or arrangement or nature of the elements of the invention are not of the essence of the invention, and that many variations, substitutions, and modifications may be made, in departure from their particular construction and characterization in the drawings and foregoing description, without departing from the true spirit of the invention. It is therefore to be understood that the invention should be limited only by the breadth and scope of the appended claims.

What is claimed is:

1. A work piece holding table, comprising:

a table top having planar, parallel top and bottom surfaces and two parallel, longitudinally oriented slots;

ground support means for holding said table top at work height;

an elongated torque jaw, L-shaped in cross-section having a generally vertical leg and a generally horizontal leg and affixed to said table to at a right angle to the slots therein;

an elongated sliding jaw L-shaped in cross-section, having a generally vertical leg and a generally horizontal leg, said sliding jaw extending transversely across both of said slots in said table top and having two holes in its horizontal leg positioned for alignment with said slots; and two coacting releasable fasteners operatively associated with said two holes and two slots for adjustably affixing said sliding jaw to said table top; and one of the two holes in said sliding jaw being elongated in a direction for rotational movement of said sliding jaw upon release of said coacting fasteners whereby said sliding jaw can be affixed to said table top at an acute angle to said torque jaw, a pair of elongated jaw means, one of said jaw means being mounted on the vertical leg of said sliding jaw at a position to face said torque jaw, means for mounting the other of said jaw means on the vertical leg of said torque jaw at a position to face said sliding jaw and with freedom of movement toward and away from the vertical leg of said torque jaw, the vertical leg of said torque jaw including a plurality of threaded holes aligned with said other jaw means and a plurality of torque knobs, each including a threaded shank threadably received in a respective one of said threaded holes and a hand-turning means affixed to one end of said shank being engageable with said other of said jaw means for urging said other jaw means toward said sliding jaw in response to rotation of said torque knob in one direction thereby to apply clamping pressure to a work piece supported between said pair of jaw means.

2. The work piece holding table as defined in claim 1, wherein said one of the two holes in said sliding jaw has a longitudinal axis disposed at an acute angle with respect to that of said sliding jaw.

3. The work piece holding table in claim 1, wherein each slot has an inverted T-shaped cross-section including a narrower width portion above a wider width portion and said coacting releasable fasteners comprises two bolts and nuts each bolt including a bolt head having two parallel sides spaced apart slightly less than the wider width portion of the slots, more than the narrower width portion thereof, and each bolt is installed, bolt head down, within each hole and slot of said sliding jaw and table top respectively.

4. The work piece holding table in claim 3, further comprising handle means affixed to each of the nuts, each said handle means including:

A sleeve coaxially affixed to a respective nut; and an arm affixed at one end at approximately 90 degrees to said sleeve.

5. The work piece holding table in claim 1, wherein said pair of elongated jaw means is one of a variety of pairs of equal and opposing jaw means, each member of each pair having a base portion and a jaw portion, said jaw portion being especially adapted to be used for holding a particular shape and/or size of work piece.

6. The work piece holding table in claim 5, further comprising a plurality of spaced apart holes at given intervals through the vertical leg of said torque jaw at right angles thereto;

said means for mounting the other of said jaw means comprising a plurality of spaced apart holes at said given intervals through the vertical leg of said L-shaped sliding jaw at right angles thereto;

and further comprising a plurality of threaded protrusions spaced apart at said given intervals affixed to the base portion of each member of said pairs of jaw means and pointing in a direction opposite to that which the respective jaw portion faces; and a plurality of nuts cooperatively threaded with said protrusions for mounting thereupon after each of the members of said any pair of jaw means has been mounted upon said torque jaw and said sliding jaw respectively.

7. The work piece holding table in claim 6, further comprising, a longitudinal protrusion affixed to the base portion of each member of said pairs of jaw means and pointing in a direction opposite to that which the respective jaw portion faces; and wherein the vertical leg of said torque jaw and said sliding jaw each has a longitudinal indentation which in shape is the complementary of said longitudinal protrusions, in size accommodates its snug insertion, and is located so as to receive the respective member of any pair of jaw means.

* * * * *